US012188112B2

(12) United States Patent
Forsik et al.

(10) Patent No.: US 12,188,112 B2
(45) Date of Patent: Jan. 7, 2025

(54) ARTICLES FABRICATED FROM COLD-WORKED AND CASE- HARDENED ESSENTIALLY CO-FREE STAINLESS STEEL ALLOYS AND METHODS OF FABRICATION THEREOF

(71) Applicant: Carpenter Technology Corporation, Philadelphia, PA (US)

(72) Inventors: Stephane Alexis Jacques Forsik, Reading, PA (US); Mario Epler, Denver, PA (US); Alojz Kajinic, Reading, PA (US); Gaurav Lalwani, Philadelphia, PA (US); Logan Smith, West Lawn, PA (US)

(73) Assignee: Carpenter Technology Corporation, Philadelphia, PA (US)

( * ) Notice: Subject to any disclaimer, the term of this patent is extended or adjusted under 35 U.S.C. 154(b) by 0 days.

(21) Appl. No.: 18/083,261

(22) Filed: Dec. 16, 2022

(65) Prior Publication Data

US 2023/0193439 A1 Jun. 22, 2023

Related U.S. Application Data

(60) Provisional application No. 63/291,187, filed on Dec. 17, 2021.

(51) Int. Cl.
*C22C 38/58* (2006.01)
*C21D 6/00* (2006.01)
(Continued)

(52) U.S. Cl.
CPC ..... *C22C 38/58* (2013.01); *C21D 6/004* (2013.01); *C21D 6/005* (2013.01); *C21D 6/007* (2013.01);
(Continued)

(58) Field of Classification Search
CPC ..... B22F 2003/185; B22F 2003/248; B22F 3/15; B22F 3/17; B22F 9/082; C21D 1/00;
(Continued)

(56) References Cited

U.S. PATENT DOCUMENTS 4,921,025 A 5/1990 Tipton et al.
5,308,412 A 5/1994 Shetty et al.
(Continued)

FOREIGN PATENT DOCUMENTS

EP 3299487 A1 3/2018
JP 63161170 A * 7/1988
WO WO-2022136552 A1 6/2022

OTHER PUBLICATIONS

NPL: on-line translation of JP-63161170-A, Jul. 1988 (Year: 1988).*
(Continued)

*Primary Examiner* — Jie Yang
(74) *Attorney, Agent, or Firm* — Goodwin Procter LLP

(57) ABSTRACT

A method for fabricating an article includes forming a billet consisting essentially of a stainless steel composition of
manganese 2.00 wt. %-24.00 wt. %
chromium 19.00 wt. %-30 wt. %
molybdenum 0.50 wt. %-4.0 wt. %
nitrogen 0.25 wt. %-1.10 wt. %
carbon ≤1 wt. %
phosphorus ≤0.03 wt. %
sulfur ≤1 wt. %
nickel <22 wt. %
cobalt <0.10 wt. %
silicon ≤1 wt. %
niobium ≤0.80 wt. %
oxygen ≤1 wt. %
copper ≤0.25 wt. %
balance iron.
(Continued)

The billet is annealed and cold worked to form an article. Without annealing of the article, the article is subsequently case hardened at a single case hardening temperature to form a surface layer on a top surface thereof. Articles formed with the indicated stainless steel composition with case hardened surface layers are also provided.

17 Claims, 12 Drawing Sheets

(51) Int. Cl.

| | |
|---|---|
| ***C22C 38/00*** | (2006.01) |
| ***C22C 38/02*** | (2006.01) |
| ***C22C 38/42*** | (2006.01) |
| ***C22C 38/44*** | (2006.01) |
| ***C22C 38/52*** | (2006.01) |
| *C23C 8/08* | (2006.01) |
| *C23C 8/22* | (2006.01) |
| *C23C 8/26* | (2006.01) |
| *C23C 8/32* | (2006.01) |

(52) U.S. Cl.
CPC ..... *C21D 6/008* (2013.01); *C22C 38/001* (2013.01); *C22C 38/02* (2013.01); *C22C 38/42* (2013.01); *C22C 38/44* (2013.01); *C22C 38/52* (2013.01); *C23C 8/08* (2013.01); *C23C 8/22* (2013.01); *C23C 8/26* (2013.01); *C23C 8/32* (2013.01)

(58) Field of Classification Search
CPC ..... C21D 3/00; C21D 6/002; C21D 6/004; C21D 6/005; C21D 6/007; C21D 6/008; C22C 33/0278; C22C 38/001; C22C 38/02; C22C 38/22; C22C 38/38; C22C 38/40; C22C 38/42; C22C 38/44; C22C 38/52; C22C 38/58; C23C 8/08; C23C 8/22; C23C 8/32; C23C 8/26
USPC ..... 420/38
See application file for complete search history.

(56) References Cited

U.S. PATENT DOCUMENTS

| | | | | |
|---|---|---|---|---|
| 5,503,687 | A | 4/1996 | Berns | |
| 6,093,303 | A | 7/2000 | Williams et al. | |
| 6,168,755 | B1 | 1/2001 | Biancaniello et al. | |
| 6,228,445 | B1 | 5/2001 | Tverberg | |
| 6,547,888 | B1 * | 4/2003 | Williams | C23C 8/22 148/216 |
| 7,186,304 | B2 | 3/2007 | Chin et al. | |
| 7,431,778 | B2 | 10/2008 | Somers et al. | |
| 8,845,823 | B2 | 9/2014 | Christiansen et al. | |
| 9,387,022 | B2 | 7/2016 | Koay et al. | |
| 9,574,248 | B2 | 2/2017 | Christiansen et al. | |
| 9,695,505 | B2 | 7/2017 | O'Donoghue et al. | |
| 10,023,924 | B2 | 7/2018 | Christiansen et al. | |
| 10,053,763 | B2 | 8/2018 | Trivedi et al. | |
| 10,214,805 | B2 | 2/2019 | Williams et al. | |
| 2005/0098237 | A1 | 5/2005 | Medlin | |
| 2006/0222844 | A1 * | 10/2006 | Stinson | A61L 31/124 428/323 |
| 2010/0116377 | A1 | 5/2010 | Collins et al. | |
| 2022/0136552 | A1 | 5/2022 | Shibusawa et al. | |

OTHER PUBLICATIONS

Blanco-Dalmau et al., "A Study of Nickel Allergy," Journal of Prosthetic Dentistry 52:116-119 (1984).
Hu et al., "Recent Updates for Biomaterials used in Total Hip Arthroplasty," Biomaterials Research 22: Article No. 33 (2018).
Jensen et al., "Cobalt Exposure and Cancer Risk," Crit. Rev.Toxicol. 20(6):427-437 (1990).
Kanaji et al., "Cytotoxic Effects of Cobalt and Nickel Icons on Osteocytes In Vitro," Journal of Othopaedic Surgery and Research 9: Article 91 (2014).
Habibi et al., "Microstructural Characterisation of a Plasma Carburised Low Carbon Co—Cr Alloy," Surface Engineering 23(1):45-51 (2007).
Liao et al., "CoCrMo Metal-on-Metal Hip Replacements," Physical Chemistry Physics, 15(3):1-26 (2013).
McTighe et al., "Metallic Alloys in Total Hip Arthroplasty," Controversial Issues 5(2) 2015.
Ren et al., "In Vitro Study of Platelet Adhesion on Medical Nickel-Free Stainless Steel Surface," Materials Letters 59:1785-1789 (2005).
Walley et al. "The Chronicle of a Stainless Steel Orthopaedic Inplant," The Orthoaedic Journal of Harvard Medical School, vol. 17 (2016).
Walter et al., "Stainless Steel for Medical Implants: the High Level of Nitrogen in BioDur 108 Stainless Steel provides Enhanced Mechanical and Physical Properties for Medical Implants," Advanced Materials & Processes 164(4):84-86 (2006).
Carpenter Technology Corporation: "Micro-Melt NCORR," Alloy Digest 64(11) Nov. 1, 2015 (Nov. 1, 2015), XP093032247, ISSN: 0002-614X, DOI: 10.31399/asm.ad.ss1231 Retrieved from the Internet: URL:https://dl.asminternational.org/alloydigest/article-pdf/64/11/SS-1231/375318/ad_v64_11_ss-1231.pdf> [retrieved on Mar. 16, 2023].
Carpenter Technology Corporation: "Data Sheet," Jun. 1, 2020 (Jun. 1, 2020) XP093032248, Retrieved from the Internet: URL:https://www.carpentertechnology.com/hubfs/Data%20Sheets/Carpenter_Technology_Bio Dur_734_Datasheet_v02-22.pdf [retrieved on Mar. 16, 2023].
International Preliminary Report on Patentability for International Application No. PCT/US2022/053218 issued Jun. 13, 2024 (7 pages).
International Search Report for International Application No. PCT/US2022/053218 mailed Mar. 28, 2023 (4 pages).
Kosmac (2015) EURO INOX: "Surface Hardening of.Stainless Steels," Materials and Applications Series 20, pp. 1-17, XP002808859.
Kuncicka et al. (2017) "Advances in metals and alloys for joint replacement," Progress in Materials Science 88:232-280.
Nouri et al. (2021) "Stainless steels in orthopedices," Structural Biomaterials 67-101 XP002808858.
Technical Data Sheet: "CarTech BioDur 108 Alloy," Dec. 31, 2020 (Dec. 31, 2020), XP093032413, Retrieved from the Internet: URL: https _: / /www.carpentertechnology.com/hubfs/7407324/Material%20Saftey%20Data%20She ets/Biodur%20108.pdf [retrieved on Mar. 16, 2023].

* cited by examiner

CONDITION A

CONDITION B

CONDITION D

Condition F

Condition F

Condition D

Condition E

Condition F

Condition G

Condition F

Condition G

ARTICLES FABRICATED FROM COLD-WORKED AND CASE- HARDENED ESSENTIALLY CO-FREE STAINLESS STEEL ALLOYS AND METHODS OF FABRICATION THEREOF

CROSS REFERENCE TO RELATED APPLICATION

This application claims priority to U.S. Provisional Application No. 63/291,187, filed on Dec. 17, 2021, which is incorporated by reference herein in its entirety and for all purposes.

FIELD OF THE INVENTION

Embodiments of the invention relate to a method of processing essentially cobalt-free wrought stainless steels and articles of manufacture made therefrom. More particularly, certain embodiments of the invention relate to the processing of stainless steels to increase their strength and create a hardened surface that offers improved resistance to wear, corrosion, and fatigue. Certain articles processed according to various embodiments of the invention are suitable for medical load-bearing applications such as articulating orthopedic implants.

BACKGROUND

Stainless steels and cobalt-chromium-molybdenum alloys (CoCrMo or CCM) are metallic materials commonly used in orthopedic applications due to their strength, resistance to wear, fatigue and corrosion, and biocompatibility. CoCrMo alloys with 27-30 wt. % of chromium and 5-7 wt. % of molybdenum are used either in the cast (ASTM F75) or wrought (ASTM F1237) condition. Other CoCrMo alloys with different ratios of cobalt/chromium/molybdenum are used in the wrought condition (see e.g., specifications ASTM F90, F562, F799, F1537). Stainless steels have an iron base and additions of chromium, nickel, and molybdenum (ASTM F138) or additions of chromium, nickel, manganese, molybdenum, and nitrogen (ASTM F1586) and are used in the wrought condition. Each of these ASTM standards are hereby incorporated by reference in their entireties.

An essentially Ni- and Co-free stainless steel composition is specified in ASTM standard F2229-21 Standard Specification for Wrought, Nitrogen Strengthened 23Manganese-21Chromium-1Molybdenum Low-Nickel Stainless Steel Alloy Bar and Wire for Surgical Implants (UNS S29108) (referred to herein as "ASTM F2229 stainless steel"), which is hereby incorporated by reference in its entirety, for all purposes. This alloy is also discussed in, e.g., U.S. Patent Publication US20100116377A1, U.S. Pat. No. 9,387,022B2, and U.S. patent Ser. No. 10/214,805B2. Examples of materials that comply with this standard are BioDur® 108 stainless steel, available from Carpenter Technology Corporation (USA) and CHRONIFER® 108 nickel free stainless steel, available from L. Klein SA (Switzerland).

A similar Co-free stainless steel composition is specified in ASTM standard F1586-21 Standard Specification for Wrought Nitrogen Strengthened 21Chromium-10Nickel-3Manganese-2.5Molybdenum Stainless Steel Alloy Bar for Surgical Implants (UNS S31675), referred to herein as "ASTM F1586 stainless steel", which is hereby incorporated by reference in its entirety, for all purposes. This alloy is discussed in U.S. Pat. No. 9,695,505B2 and U.S. Pat. No. 9,387,022B2. An example of a material that complies with the standard is BioDur® 734 stainless steel, available from Carpenter Technology Corporation (USA).

Another similar Co-free stainless steel composition is the high-nitrogen stainless steel described in, e.g., U.S. Pat. No. 6,168,755, referred to herein as "high nitrogen, high chromium stainless steel" ("HNHC stainless steel"). An example of a material that includes this composition is a material that complies with ASM SS-1231, such as Micro-Melt® NCORR™ stainless steel, available from Carpenter Technology Corporation (USA).

To broaden the types of applications in which they may be used, a need exists for processing ASTM F2229 stainless steel, ASTM F1586 stainless steel, and HNHC stainless steel to increase their strength and resistance to wear, corrosion, and fatigue.

SUMMARY

Embodiments of the invention may be used in various applications, such as for fabrication of articulating orthopedic implants. For articulating orthopedic implants, properties required for the articulating surface significantly differ from those required for the bulk of the material as the articulating surface is preferably wear resistant and at the same time have excellent fatigue, corrosion and tribocorrosion properties. On the other hand, the bulk of the alloy has its own requirements in terms of Young's modulus of elasticity, fracture toughness, etc. For these reasons, alloys for articulating orthopedic applications are preferably specifically processed for the surface of the material to be significantly much harder than the bulk of the material.

The processes described herein may also be used to provide articles for other applications, such as watch components, electrical components, or drilling components, i.e., any applications that require a hard, wear resistant surface in combination with bulk properties provided by ASTM F2229 stainless steel, ASTM F1586 stainless steel or high nitrogen, high chromium stainless steel ("HNHC stainless steel") such as the material described in U.S. Pat. No. 6,168,755.

In an aspect, embodiments of the invention relate to a method for fabricating an article. The method includes the steps of: forming a billet including or consisting essentially of a stainless steel composition of manganese 2.00 wt. %-24.00 wt. %, chromium 19.00 wt. %-30 wt. %, molybdenum 0.50 wt. %-4.0 wt. %, nitrogen 0.25 wt. %-1.10 wt. %, carbon ≤1 wt. %, phosphorus ≤0.03 wt. %, sulfur ≤1 wt. %, nickel <22 wt. %, cobalt <0.10 wt. %, silicon ≤1 wt. %, niobium ≤0.80 wt. %, oxygen ≤1 wt. %, copper ≤0.25 wt. %, balance iron; annealing the billet; cold working the billet to form the article; and without annealing of the article, subsequently case hardening the article at a single case hardening temperature to form a surface layer on a top surface thereof.

One or more of the following features may be included. The stainless steel composition may include: manganese 21.00 wt. %-24.00 wt. %, chromium 19.00 wt. %-23.00 wt. %, molybdenum 0.50 wt. %-1.50 wt. %, nitrogen 0.85 wt. %-1.10 wt. %, carbon ≤0.08 wt. %, phosphorus ≤0.03 wt. %, sulfur ≤0.01 wt. %, nickel ≤0.05 wt. %, cobalt <0.1 wt. %, silicon ≤0.75 wt. %, niobium 0 wt. %, copper ≤0.25 wt. %, balance iron.

The stainless steel composition may include: manganese 2.00 wt. %-4.25 wt. %, chromium 19.5 wt. %-22.0 wt. %, molybdenum 2.0 wt. %-3.0 wt. %, nitrogen 0.25 wt. %-0.50 wt. %, carbon ≤0.08 wt. %, phosphorus ≤0.025 wt. %, sulfur ≤0.01 wt. %, nickel 9.0 wt. %-11.0 wt. %, cobalt <0.10 wt %, silicon ≤0.75 wt. %, niobium 0.25 wt. %-0.80 wt. %, copper ≤0.25 wt. %, balance iron.

The stainless steel composition may include: manganese 5.85 wt. %-15 wt. %, chromium 27 wt. %-30 wt. %, molybdenum 1.5 wt. %-4.0 wt. %, nitrogen 0.8 wt. %-0.97 wt. %, phosphorus ≤0.02 wt. %, nickel 8 wt. %-22 wt. %, cobalt <0.01 wt. %, silicon, oxygen, carbon, and sulfur such that (silicon+oxygen+carbon+sulfur)≤1 wt. %, niobium 0 wt. %, copper ≤0.01 wt. %, balance iron.

Forming the billet may include melting and remelting an ingot under air, vacuum or slag and forging the ingot to make a billet.

Forming the billet may include forming a powder comprising the stainless steel composition; and pressing the powder to form the billet.

Cold working the billet may include at least one of cold forming, cold rolling, cold drawing, shot peening, or pilgering.

The case hardening may be performed at a single temperature selected from a range of 400° C.-1000° C. (752° F.-1832° F.). The case hardening may be performed for a duration selected from a range of 1 hour to 16 hours.

Case hardening may include boriding, carburizing, nitriding, carbonitriding, and/or a combination thereof.

The surface layer may include a surface hardness of at least 350 HV. The surface layer may include the billet stainless steel composition and further include at least one of carbon, nitrogen, boron, or a combination diffused therein.

The article may include an articulating orthopedic device element, a watch component, an electrical component, or a drilling component.

In another aspect, embodiments of the invention relate to an articulating orthopedic device. The articulating orthopedic device may include: a first element comprising a first articular surface; and a second element including a second articular surface configured to articulate with the first articular surface, the first and second elements each consisting essentially of a stainless steel composition of manganese 2.00 wt. %-24.00 wt. %, chromium 19.00 wt. %-30 wt. %, molybdenum 0.50 wt. %-4.00 wt. %, nitrogen 0.25 wt. %-1.10 wt. %, carbon ≤1 wt. %, phosphorus ≤0.03 wt. %, sulfur ≤1 wt. %, nickel ≤22.00 wt. %, cobalt <0.10 wt. %, silicon ≤1 wt. %, niobium ≤0.80 wt. %, oxygen ≤1 wt. %, copper ≤0.25 wt. %, balance iron. The first and second articular surfaces each include a surface layer including or consisting essentially of the stainless steel composition and further including at least one of carbon, nitrogen, or boron diffused therein.

One or more of the following features may be included. The surface layer may have a surface hardness of at least 350 HV. The articulating orthopedic device may further include an acetabular cup disposed between the first and second elements. The acetabular cup may include a metal, a ceramic, and/or a polymer.

In yet another aspect, embodiments of the invention relate to a stainless steel article. The stainless steel article includes a bulk material having at least one of a hardness of at least 300 HV or a yield strength of at least 145 ksi and consisting essentially of a stainless steel composition of manganese 2.00 wt. %-24.00 wt. %, chromium 19.00 wt. %-30 wt. %, molybdenum 0.50 wt. %-4.00 wt. %, nitrogen 0.25 wt. %-1.10 wt. %, carbon ≤1 wt. %, phosphorus ≤0.03 wt. %, sulfur ≤1 wt. %, nickel ≤22.00 wt. %, cobalt <0.10 wt. %, silicon ≤1 wt. %, niobium ≤0.80 wt. %, oxygen ≤1 wt. %, copper ≤0.25 wt. %, balance iron; and a surface layer disposed on the bulk material. The surface layer includes or consists essentially of the stainless steel composition and further includes at least one of carbon, nitrogen, boron, or a combination thereof diffused therein.

One or more of the following features may be included. The surface layer may have a thickness selected from a range of 10 micrometers to 1000 micrometers, or a range of 30 micrometers to 40 micrometers. A carbon concentration may range from at least 0.10 wt. % at a top surface of the surface layer to <0.08 wt. % in bulk material.

A nitrogen concentration may range from at least 1.10 wt. % at a top surface of the surface layer to a range of 0.85 wt. % to 1.10 wt. % N in the bulk material, and the nitrogen concentration in the surface layer may be higher than in the bulk material. A boron concentration may range from at least 0.10 wt. % at a top surface of the surface layer to 0 wt. % in the bulk material.

The stainless steel article may be an articulating orthopedic device element, a watch component, an electrical component, or a drilling component.

DETAILED DESCRIPTION

Alloy

Figure 1:
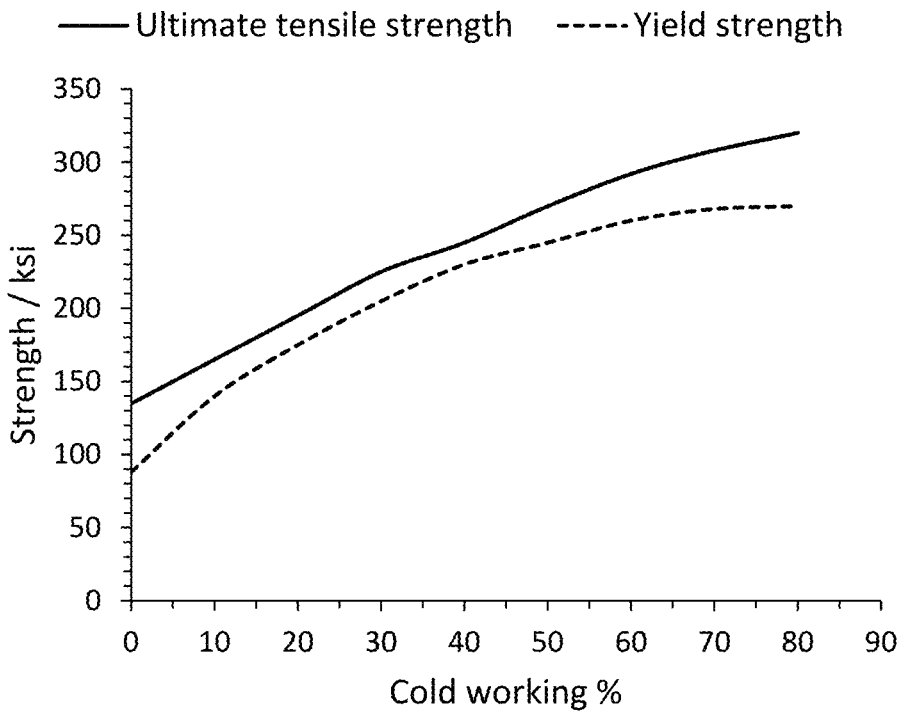
FIG. 1 is a chart of the yield strength (YS) and ultimate tensile strength (UTS) of ASTM F2229 stainless steel such as BioDur® 108 stainless steel as a function of the percent of cold working.

Processes in accordance with embodiments of the invention modify stainless steel alloys that comply with (i) the ASTM F2229 stainless steel composition, e.g., commercially available BioDur® 108 stainless steel, (ii) the ASTM F1586 stainless steel composition, e.g., commercially available BioDur® 734 stainless steel, or (iii) high nitrogen, high chromium stainless steel ("HNHC stainless steel"), e.g., as described in U.S. Pat. No. 6,168,755, also described under the filing code ASM SS-1231 in the "Alloy Digest—Data on World Wide Metals and Alloys" published by ASM International (American Society for Metals), e.g., commercially available as Micro-Melt® NCORR™ stainless steel. All three of these commercially available alloys are manufactured by Carpenter Technology Corporation.

In particular, ASTM F2229 stainless steel is an essentially nickel- and cobalt-free nitrogen-strengthened stainless steel with excellent biocompatibility and approved by the Federal Drug Administration for medical use. It is produced by the Electro-Slag Remelting (ESR) process to assure its microstructural integrity and cleanness and is used in applications such as implantable orthopedic devices, high-strength surgical instrumentation, and orthodontic devices. With no intentional additions of cobalt, it complies with the European Union Medical Device Regulation 2017/745 that requires devices containing more than 0.10 wt. % cobalt content to indicate the presence of cobalt as a potential carcinogenic, mutagenic, reproductive toxin substance. ASTM F2229 stainless steel also does not contain intentionally added nickel, a metal known to cause cutaneous inflammations and to lead to allergy reactions, teratogenicity and carcinogenicity in medical application (see Yang et al., Nickel-free austenitic stainless steels for medical applications, *Sci. Technol. Adv. Mater.* 11 (2010) 014105). Despite its known advantages, the use of ASTM F2229 stainless steel is limited in view of its relative softness when manufactured by conventional methods, e.g., typically about 300 HV. BioDur® 108 stainless steel manufactured by Carpenter Technology and CHRONIFER® 108 nickel free stainless steel distributed by L. Klein SA (Switzerland) are examples of an alloy compatible with the ASTM F2229 stainless steel standard.

ASTM F1586 stainless steel is an essentially cobalt-free nitrogen-strengthened stainless steel approved by the Federal Drug Administration for medical use. It is also compatible with the European Union Medical Device Regulation 2017/745 and used in implantable orthopedic parts such as bone plates, bone screws, and hip and knee components. The ASTM F1586 stainless steel standard calls for 9.00 to 11.00 wt. % Ni. BioDur® 734 manufactured by Carpenter Technology is an example of an alloy compatible with the ASTM F1586 stainless steel standard.

HNHC stainless steel is an essentially cobalt-free nitrogen-strengthened stainless steel manufactured using a powder metallurgy process consisting in atomizing and consolidating powder to form a billet. It is also compatible with the European Union Medical Device Regulation 2017/745 and contains up to 8.00 wt. % Ni. Its composition renders it able to generate high levels of strength through cold working.

Stainless steels that may be processed in accordance with embodiments of the invention have compositions selected from the range indicated in the fifth column of Table 1 below. This range encompasses the ranges for the ASTM F2229 stainless steel composition, the ASTM F1586 stainless steel composition, and the HNHC stainless steel composition, which are also given in Table 1. The preferred limits for each element are discussed below. The balance of all three alloys is iron and impurities resulting from normal manufacture.

TABLE 1

Composition of stainless steels in wt. %.

| Element | ASTM F2229 | ASTM F1586 | HNHC | Range |
|---|---|---|---|---|
| Fe | Bal. | Bal. | Bal. | Bal. |
| Co | <0.10 | <0.10 | <0.10 | <0.10 |
| Mn | 21.00-24.00 | 2.00-4.25 | 5.85-15 | 2.00-24.00 |
| Cr | 19.00-23.00 | 19.5-22.0 | 27-30 | 19.00-30 |
| Mo | 0.50-1.50 | 2.0-3.0 | 1.5-4.0 | 0.50-4.0 |
| N | 0.85-1.10 | 0.25-0.50 | 0.8-0.97 | 0.25-1.10 |
| Ni | ≤0.05 | 9.0-11.0 | 8-22 | ≤22 |
| Nb | 0 | 0.25-0.80 | 0 | ≤0.80 |
| C | ≤0.08 | ≤0.08 | Impurity only* | ≤1 |
| P | ≤0.03 | <0.025 | ≤0.02 | ≤0.03 |
| S | ≤0.01 | ≤0.01 | Impurity only* | ≤1 |
| Si | ≤0.75 | ≤0.75 | Impurity only* | ≤1 |
| O | Not intentionally added | Not intentionally added | Impurity only* | ≤1 |
| Cu | ≤0.25 | ≤0.25 | ≤0.01 | ≤0.25 |

*silicon, oxygen, carbon, and sulfur such that (silicon + oxygen + carbon + sulfur) ≤ 1 wt. %

TABLE 2

Exemplary compositions of HNHC stainless steels.

| Element | Based on disclosure of U.S. Pat. No. 6,168,755 | Preferred #1 | Preferred #2 (ASM SS-1231) |
|---|---|---|---|
| Fe | Bal. | Bal. | Bal. |
| Co | <0.10 | <0.10 | <0.10 |
| Mn | 6-15 | 5.85-6.15 | 6.00 |
| Cr | 27-30 | 29.30-29.70 | 29.50 |
| Mo | 1.5-4.0 | 1.85-2.15 | 2.00 |
| N | 0.8-0.97 | 0.80-0.90 | 0.85 |
| Ni | 8-22 | 14.80-15.20 | 15.00 |
| Nb | 0 | 0 | 0 |
| C | Impurity only* | ≤0.030 | ≤0.030 |
| P | Impurity only | ≤0.020 | ≤0.020 |
| S | Impurity only* | ≤0.004 | 0.004 |
| Si | Impurity only* | 0.45-0.55 | ≤0.50 |
| O | Impurity only* | Not intentionally added | Not intentionally added |
| Cu | Impurity only | ≤0.01 | ≤0.01 |

*silicon, oxygen, carbon, and sulfur such that (silicon + oxygen + carbon + sulfur) ≤ 1 wt. %

Cobalt is an element that is not intentionally added to any of the alloys in Tables 1 and 2. Residual cobalt resulting from normal manufacture is kept below 0.10 wt. % to be compatible with the European Union Medical Device Regulation 2017/745 and preferably below 0.010 wt. %.

The major function of manganese in the subject alloys is to increase solubility for nitrogen; the specific level of manganese (within the ranges listed in Tables 1 and 2) is selected to provide the desired nitrogen level. 21.00 wt. % to 24.00 wt. % of Ni is needed in ASTM F2229 stainless steel to allow up to 1.10 wt. % of N in solution. Only 2.00 wt. % to 4.25 wt. % of Ni is needed in ASTM F1586 stainless steel because the desired N level is 0.25 wt. % to 0.50 wt. % and the extra Ni contributes to the N solubility. The HNHC stainless steel requires up to 15 wt. % of Mn to allow 0.80 wt. % to 0.97 wt. % of N in solution.

Chromium increases both corrosion resistance and nitrogen solubility. However, increasing chromium also decreases austenitic stability. The level of chromium (within the ranges listed in Tables 1 and 2) is selected to provide the required corrosion resistance; the levels of other elements are then adjusted as necessary to maintain austenitic stability. The ASTM F2229 and ASTM F1586 stainless steels require similar levels of Cr (19.00 wt. % to 23.00 wt. %) to reach the desired corrosion resistance. The HNHC stainless steel requires 27 wt. % to 30 wt. % Cr for extra corrosion resistance and use in harsher environment.

Molybdenum significantly improves resistance to corrosion, particularly the types of localized corrosion of concern in implant applications. However, molybdenum also significantly decreases austenitic stability. Like chromium, the levels of molybdenum (within the ranges listed in Tables 1 and 2) are selected to provide the required corrosion resistance and are balanced by the other elements; the levels of other elements are then adjusted as necessary to maintain austenitic stability.

Nitrogen plays a key role in maintaining austenitic stability in the alloys listed in Tables 1 and 2, as well as significantly contributing to corrosion resistance and determining the strength level. A high level of nitrogen increases the strain hardening rate of a stainless steel during cold working, i.e., the strength gained during a cold working deformation step with a given level of cold working increases with the level of nitrogen. Excessive nitrogen levels can result in difficulties in melting, atomizing, consolidating, forging and other process steps. Nitrogen levels (within the ranges listed in Tables 1 and 2) are controlled by controlling the levels of the other elements that affect nitrogen solubility.

Silicon additions provide deoxidation during the melting and refining processes; the specific levels used depend upon the melting process employed. Since increasing silicon decreases both austenitic stability and nitrogen solubility, the silicon level is limited to 0.75 wt. % in ASTM F2229 and ASTM F1586 stainless steels, and no more than 1 wt. % (in total with silicon, oxygen, carbon and sulfur) in HNHC stainless steel described in, e.g., U.S. Pat. No. 6,168,755.

Phosphorus is not intentionally added but is present as an impurity in the raw materials commonly used for melting alloys such as those in Tables 1 and 2. Since excessive levels of phosphorus can decrease certain properties such as ductility, melting and refining procedures are used such that phosphorus level is less than 0.020 wt. % of 0.025 wt. % at most.

Like phosphorus, sulfur is not intentionally added, but is present as an impurity in the raw materials commonly used for melting alloys such as those in Tables 1 and 2. Since excessive levels of sulfur also can decrease certain properties such as ductility, melting and refining procedures are used such that the sulfur level is less than 0.010 wt. % in ASTM F2229 and ASTM F1586 stainless steels, and no more than 1 wt. % (in total with silicon, oxygen, carbon and sulfur) in HNHC stainless steel described in, e.g., U.S. Pat. No. 6,168,755.

Although copper is often added to stainless alloys to enhance resistance to certain types of corrosion, copper is not intentionally added to the alloys in Tables 1 and 2, which are typically intended for implant applications. The level of copper (which may be present as an impurity in raw materials) is restricted to less than 0.25 wt. % in ASTM F2229 and ASTM F1586 stainless steels and less than 0.01 wt. % in the HNHC stainless steel described in, e.g., U.S. Pat. No. 6,168,755.

Carbon in solid solution helps stabilize the austenite phase. Carbon also can combine with various elements to form carbide phases. Since formation of chromium carbides on grain boundaries can result in decreased corrosion resistance, austenitic alloys designed for high corrosion resistance often have low carbon levels. Carbon in the ASTM F2229 and ASTM F1586 stainless steel alloys is restricted to levels less than 0.08 wt. %, and no more than 1 wt. % (in total with silicon, oxygen, carbon and sulfur) in HNHC stainless steel described in, e.g., U.S. Pat. No. 6,168,755.

The processes described herein employ methods known to those of skill in the art to manufacture the alloys described above, and include multiple additional steps to form an article including a surface layer. The processes include melting of raw material, atomizing or casting the molten metal, conversion from ingot to billet during forging, and a final annealing heat treatment of the billet. This is followed by a cold working step, i.e., a deformation step performed at low temperature to shape the article and increase its bulk yield strength and ultimate tensile strength. Immediately after cold working, a case hardening step of the article is performed at low temperature to improve the properties of the surface of the article. Unlike conventional methods, the case hardening step is not preceded by an annealing step. Cold working strains the material and makes it stronger; in contrast, annealing relaxes the material and makes it softer.

Accordingly, annealing an article after cold working defeats the purpose of the cold working step, resulting in the alloy losing strength gained during cold working.

Billet Forming and Annealing

Ingots made from the ASTM F2229 stainless steel described above may be manufactured by arc melting or vacuum induction melting (VIM) followed by electro-slag remelting (ESR). After solidification, ingots of ASTM F2229 stainless steel are homogenized in a furnace to ensure a homogenous microstructure and converted to billets via hot working on a press or radial forging machine as per the Carpenter Technology BioDur® 108 technical datasheet, which is hereby incorporated by reference in its entirety, for all purposes (Carpenter Technology Corporation, CarTech® BioDur® 108 Alloy). After forging, billets of ASTM F2229 stainless steel may be annealed to a temperature ranging from 1900° F. (1038° C.) to 2100° F. (1149° C.) for a duration of one hour and then rapidly cooled to room temperature to prevent the formation of chromium nitrides between 1500° F. (816° C.) and 1800° F. (982° C.). Within the context of this disclosure, this annealing step is defined as a thermal process performed in air, protective atmosphere or vacuum to relax internal stresses and soften the material through recovery or recrystallization.

Ingots made from the ASTM F1586 stainless steel described above may be manufactured by arc melting or vacuum induction melting (VIM) followed by electro-slag remelting (ESR). After homogenization and forging, billets of ASTM F1586 stainless steel may be annealed to a temperature ranging from 1922° F. (1050° C.) to 2102° F. (1150° C.) and rapidly quenched to prevent the formation of chromium nitrides, as per the Carpenter Technology BioDur® 734 technical datasheet, which is hereby incorporated by reference in its entirety, for all purposes (Carpenter Technology Corporation, CarTech® BioDur® 734 Alloy)

The HNHC stainless steel may be manufactured using powder metallurgy (PM) technology to produce powder that is consolidated into fully dense ingots via hot isostatic pressing (HIP). After forging, the billets may be annealed at 2000° F. (1093° C.) for one hour and rapidly quenched to prevent the formation of chromium nitrides, as per the recommendations described under the filing code ASM SS-1231 in the "Alloy Digest—Data on World Wide Metals and Alloys".

Cold Working

Cold working is defined as the forming step consisting of but not limited to a combination of cold rolling, cold drawing, shot peening, and/or pilgering performed at or below ⅔ of the solidus temperature. For most stainless steels, the solidus temperature (defined as the highest temperature below which the alloy is fully solid) is at least 2400° F. (1316° C.) and ⅔ of this temperature is about 1600° F. (871° C.). In the rest of the disclosure, a cold forming step is understood as a forming step performed between room temperature and 1600° F. (871° C.). Cold working performed in the 1000° F. (538° C.) to 1600° F. (871° C.) temperature range may sometimes be referred to as "warm working". Accordingly, as used herein, "cold working" encompasses cold and warm working, i.e., a forming step performed between room temperature and 1600° F. (871° C.).

Warm working (cold working) performed in the 1000° F. (538° C.) to 1600° F. (871° C.) temperature range, may be a preferred processing step as a deformation performed in that temperature range is easier, i.e., requires less external strength applied to the article to reach the desired level of deformation. Deformation performed in the 1000° F. (538° C.) to 1600° F. (871° C.) temperature range introduces less defects (for example dislocations, point defects) in the article and creates less energy stored in the article. Articles with less stored energy available for recovery or recrystallization are more likely to maintain their required bulk strength during further process, such as a case hardening step.

Because of their specific chemistries and unlike most other steel alloys, there is no hardening mechanism that can be used to harden ASTM F2229 stainless steel, ASTM F1586 stainless steel or HNHC stainless steel at high temperature, and cold working is the only processing step that can harden them and make them compatible with load-bearing applications. Accordingly, the alloys are preferably cold worked (i.e., deformed at a low temperature below 1600° F./871° C.) to make them stronger.

ASTM F2229 stainless steel, ASTM F1586 stainless steel and HNHC stainless steel have different compositions and different work hardenability, i.e., they harden differently when subjected to the same cold forming step and require different levels of cold working to reach the same level of mechanical properties.

For example, FIG. 1 is adapted from MJ Walter, Stainless steel for medical implants: The high level of nitrogen in BioDur® 108 stainless steel provides enhanced mechanical and physical properties for medical implants, *Adv. Mater. Process.* 164 (2006) 84-86, and also adapted from the Carpenter Technology BIODUR® 108 STAINLESS data sheet, which are hereby incorporated by reference in their entireties, for all purposes. Referring to FIG. 1, ASTM F2229 stainless steel in the annealed condition (cold working=0%) offers 88 ksi yield strength (YS)/135 ksi ultimate tensile strength (UTS) at room temperature and 270 ksi YS/320 ksi UTS after 80% of cold working. A suitable cold working process of 15% is preferred for a part made of that alloy to reach the ASTM 799 standard mechanical properties (120 ksi YS/170 ksi UTS at room temperature), which is hereby incorporated by reference in its entirety, for all purposes. For other applications, a different level of cold working may be desired to target a specific combination of YS and UTS.

Figure 2:
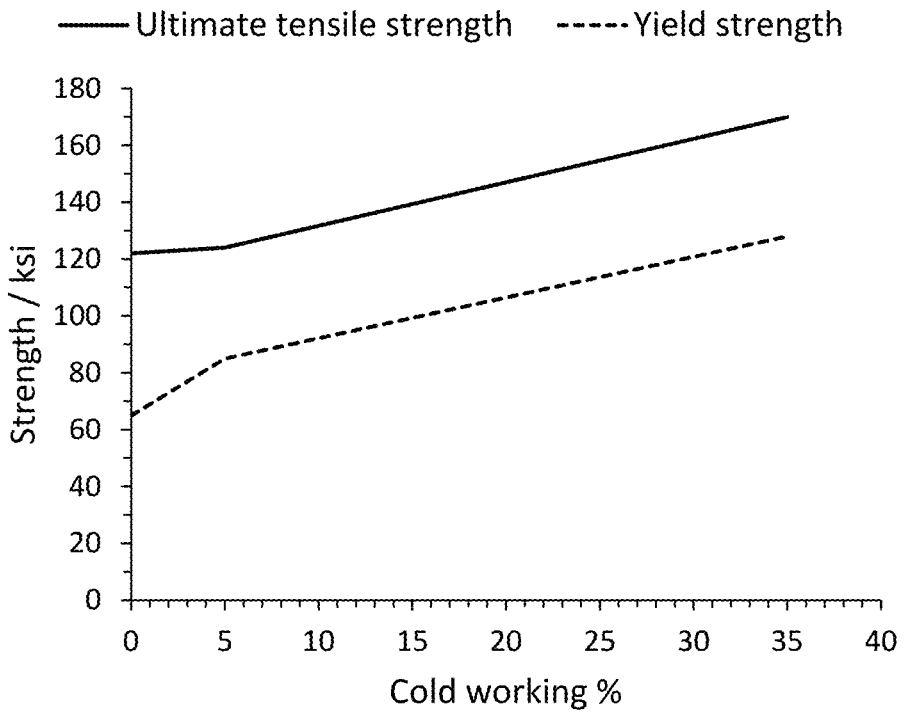
FIG. 2 is a chart of the YS and UTS of ASTM F1586 stainless steel such as BioDur® 734 stainless steel as a function of the percent of cold working.

In another example, FIG. 2 is adapted from the Carpenter Technology BIODUR® 734 STAINLESS datasheet, which is hereby incorporated by reference in its entirety, for all purposes. Referring to FIG. 2, ASTM F1586 stainless steel in the annealed condition offers 65 ksi YS/122 ksi UTS at room temperature and 128 ksi YS/170 ksi UTS after 35% of cold working. A suitable cold working process of at least 40% is preferred for a part made of that alloy to reach the ASTM 799 standard mechanical properties (120 ksi YS/170 ksi UTS at room temperature). Similarly, for other applications, a different level of cold working may be desired to target a specific combination of YS and UTS.

Figure 3:
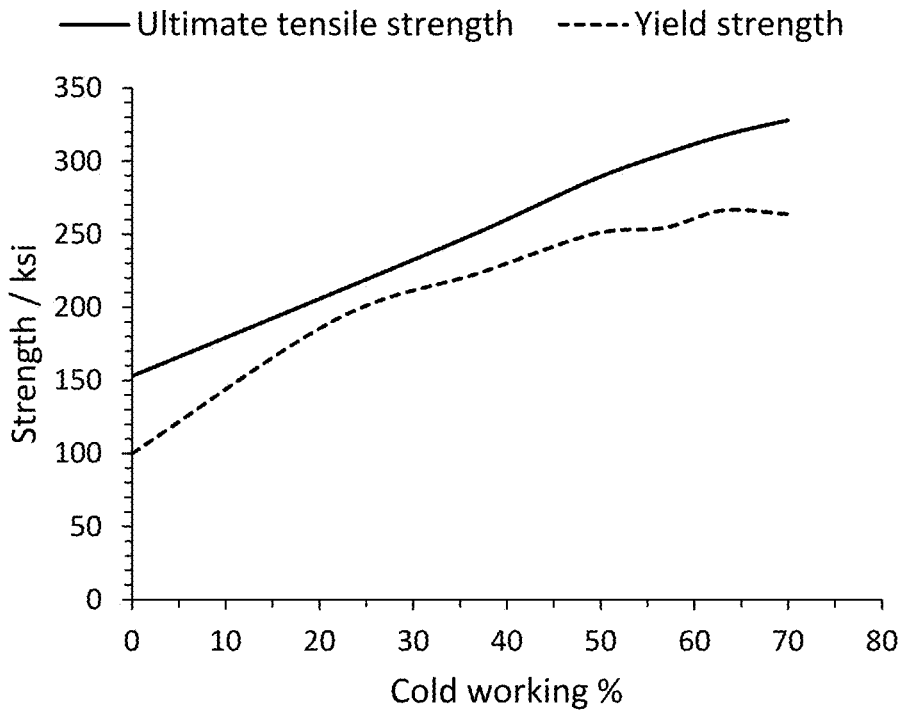
FIG. 3 is a chart of the YS and UTS of high nitrogen, high chromium stainless steel ("HNHC stainless steel") such as ASM SS-1231 stainless steel as a function of the percent of cold working.

In a last example, FIG. 3 is adapted from the Carpenter Technology CarTech® Micro-Melt® NCORR™ Stainless Steel datasheet, which is hereby incorporated by reference in its entirety, for all purposes. The HNHC stainless steel in the annealed condition offers 100 ksi YS/153 ksi UTS at room temperature and 264 ksi YS/328 ksi UTS after 70% of cold working. A suitable cold working process of at least 15% is preferred for a part made of that alloy to reach the ASTM 799 standard mechanical properties (120 ksi YS/170 ksi UTS at room temperature). Similarly, for other applications, a different level of cold working may be desired to target a specific combination of YS and UTS.

Case Hardening

Case hardening is a surface modification process used to harden the surface layer of stainless steels. Accordingly, a case-hardening step may be used to increase the hardness of the surface of ASTM F2229 stainless steel, ASTM F1586 stainless steel, or HNHC stainless steel such as ASM SS-1231 stainless steel via diffusion of interstitial elements such as carbon, nitrogen, boron or a combination thereof in, for example, a gas, ion or plasma media or in vacuum. In the case of pack carburizing, pack nitriding or pack boriding, the case hardening step may be conducted in a material that is enriched in carbon, nitrogen, or boron. This step may include carburizing, nitriding, boriding, carbonitriding or a combination thereof at a case hardening temperature below 1000° C. to prevent the formation of deleterious second phases. This process results in the formation of a surface layer that is much harder than the bulk of the material and also has improved resistance to wear, corrosion, and fatigue damage.

Case hardening can be used to improve the surface properties of ASTM F2229 stainless steel, ASTM F1586 stainless steel or HNHC stainless steel and improve the corrosion, fatigue and wear resistance of these alloys, resulting in better performances in various applications, such as articulating orthopedic applications.

In particular, case hardening is a heat treatment process in a C-rich, N-rich, B-rich, or a combination thereof or other suitable environment used to alter the near surface chemistry of the alloy through a diffusion process to alter the properties. It allows interstitial elements to diffuse into the surface layer of the material. The case-hardening process can be boriding (diffusion of boron), carburizing (diffusion of carbon), nitriding (diffusion of nitrogen), carbonitriding (simultaneous diffusion of carbon and nitrogen) or a combination thereof. The case hardening process can be performed using gas, ion or plasma media or in vacuum. During the case hardening process, interstitial elements diffuse into the surface layer form a supersaturated solid solution at the surface of the material. The process is performed at a temperature sufficiently low to prevent the formation of precipitates and detrimental second phases such as borides, carbides, nitrides or carbonitrides. See X Y Li, N Habibi, T Bell, H Dong, "Microstructural characterisation of a plasma carburised low carbon Co—Cr alloy", *Surf Eng.* 23 (2007) 45-51. Case hardening temperatures range between 350° C. and 1000° C., e.g., 400° C. to 1000° C., and durations can be as long as 60 hours and as short as 1 hour. See, for example, S R Collins, P C Williams, S V Marx, A Heuer, F Ernst, H Kahn, "Low-Temperature Carburization of Austenitic Stainless Steels," in: *Heat Treat. Irons Steels*, ASM International, 2014: pp. 451-460.

In some embodiments described herein, case hardening temperatures range between 400° C. and 1000° C., such as 500° C., 550° C., 750° C., or 960° C. In some embodiments, case hardening periods range from 1 hour to 16 hours, such as 1 hour, 4 hours, 5 hours or 16 hours. The temperature at which the alloy is case hardened increases the diffusivity of carbon, nitrogen and boron, i.e., the higher the case hardening temperature, the easier it is to introduce a larger amount of interstitial elements in the case layer and the thicker the caser layer. A case hardening step performed at a higher temperature is more efficient, i.e. faster, than the same case hardening step performed at a lower temperature but can lead in Cr- and N-rich stainless steels to the formation of carbide or nitride that are detrimental to the corrosion resistance of the alloy. The case hardening temperature and time must be balanced and adapted to the alloy composition to create the desired case layer thickness and avoid the formation of detrimental carbide and nitride.

A minimum case surface layer thickness of 10 μm is desired to allow parts to be machined, 100 μm is a more preferred thickness and 1,000 μm is an even more preferred thickness. A surface hardness of at least 400 HV is desired for applications that require wear resistance, preferably 800 HV, more preferably 900 HV and even more preferably 1200 HV. The combination of surface hardness and case layer thickness is determined by the final application, as some applications need a shallower but harder surface layer and others need a thicker but softer case surface layer.

The case hardening is performed at a single case hardening temperature to simplify the process and minimize the risk of forming deleterious phases during the heat up and cool down ramps. Samples may be subjected to other temperatures during the case hardening process, for example during the heating part of the cycle, from room temperature to the case hardening temperature, e.g., a carburizing temperature, and during the cooling part of the cycle, from the case hardening temperature to room temperature. The case hardening cycle may be interrupted (i.e., introduction of boron, carbon, and/or nitrogen temporarily stopped) to allow interstitial elements to diffuse into the surface layer of the material, while maintaining the material at the case hardening temperature. The case hardening cycle may also include a succession of short case hardening pulses at the case hardening temperature and diffusion periods to allow interstitial elements to diffuse into the surface layer of the material.

Figure 4:
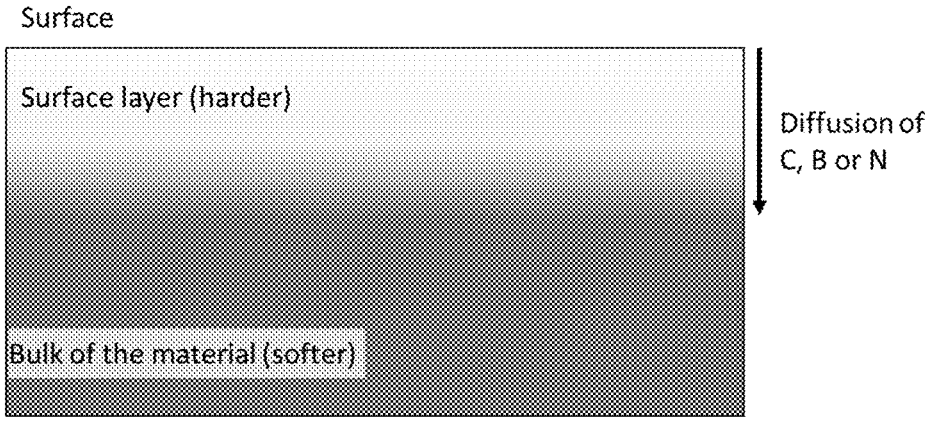
FIG. 4 is a schematic representation of a case hardening process.

The case hardening process results in the formation of a surface layer that is much harder than the bulk of the material (see schematic example in FIG. 4) and has improved resistance to wear, corrosion, and fatigue damage. In accordance with embodiments of the invention, cold-worked (including warm-worked) articles of ASTM F2229 stainless steel, ASTM F1586 stainless steel or HNHC stainless steel are subjected to case-hardening heat treatments.

A variety of case hardening heat treatment cycles are offered by various commercial vendors: Kolsterising® (proprietary to Bodycote), ExpaniteHigh-T, ExpaniteLow-T and SuperExpanite (proprietary to Expanite A/S) or Infracarb® (proprietary to ECM-USA). Similarly, commercial nitriding, carbonitriding or boriding case hardening heat treatment cycles are available from the same vendors.

An exemplary system for performing a case hardening step (carburizing step called pack carburizing) on stainless steels described herein is a high-temperature furnace, e.g., the RD7-KHE24 box furnace manufactured by Lucifer Furnaces Inc. A mixture of pelletized carbon and sodium carbonate anhydrous may be placed in a metallic container. A suitable composition may be 98% (in weight) of pelletized carbon and 2% (in weight) of sodium carbonate anhydrous. The metallic container may be a stainless steel rectangular box topped with a stainless steel lid and sealed with a high-temperature refractory cement. The metallic container with the mixture may then be placed into the furnace along with the article to be case hardened. The mixture and article are heated to the desired case hardening temperature for a sufficient period of time to obtain a surface layer on a top surface of the article with the desired concentration of interstitial elements, and are then rapidly cooled to room temperature via quenching in water, oil, air, or any other fluid.

After case hardening, interstitial elements in solution generate compressive stresses that make the surface layer much harder and more resistant to fatigue and wear than the bulk of the material. The higher concentration of interstitial elements in the surface layer makes it more resistant to corrosion damage.

Suitable levels of diffused interstitial elements in accordance with embodiments of the invention are as follows:

ASTM F2229 stainless steel

- Carburizing: ASTM F2229 stainless steel contains at most 0.08 wt. % of carbon. After carburizing, the concentration of carbon in the surface layer is at least 0.10 wt. % and preferably at most 5.00 wt. %
- Nitriding: the typical nitrogen level in the ASTM F2229 stainless steel ranges between 0.85 wt. % and 1.10 wt. %. After nitriding, the nitrogen concentration in the surface layer ranges from at least 1.10 wt. % at a top surface thereof to a range of 0.85 wt. % to 1.10 wt. % N in the bulk material, with the nitrogen concentration in the surface layer being higher than in the bulk material.
- Boriding: the nominal composition of the ASTM F2229 stainless steel does not include boron. A boriding case-hardening heat treatment results in a surface layer that contains at least 0.05 wt. % B.
- Combinations thereof.

ASTM F1586 stainless steel

- Carburizing: ASTM F1586 stainless steel contains at most 0.08 wt. % of carbon. After carburizing, the concentration of carbon in the surface layer is at least 0.10 wt. % and preferably at most 5.00 wt. %
- Nitriding: the typical nitrogen level in the ASTM F1586 stainless steel ranges between 0.25 wt. % and 0.50 wt. %. After nitriding, the nitrogen concentration in the surface layer ranges from at least 0.50 wt. % at a top surface thereof to a range of 0.25 wt. % and 0.50 wt. % N in the bulk material, with the nitrogen concentration in the surface layer being higher than in the bulk material.
- Boriding: the nominal composition of the ASTM F1586 stainless steel does not include boron. A boriding case-hardening heat treatment results in a surface layer that contains at least 0.05 wt. % B.

Combinations thereof.

HNHC stainless steel

Carburizing: the HNHC stainless steel contains at most 0.03 wt. % of carbon. After carburizing, the concentration of carbon in the surface layer is at least 0.10 wt. % and preferably at most 5.00 wt. %

Nitriding: the typical nitrogen level in the HNHC stainless steel between 0.80 wt. % and 0.90 wt. %. After nitriding, the nitrogen concentration in the surface layer ranges from at least 0.90 wt. % at a top surface thereof to a range of 0.80 wt. % to 0.80 wt. % N in the bulk material, with the nitrogen concentration in the surface layer being higher than in the bulk material.

Boriding: the nominal composition of the HNHC stainless steel does not include boron. A boriding case-hardening heat treatment results in a surface layer that contains at least 0.05 wt. % B.

Combinations thereof.

Applications

Examples of articles that may be made of the alloy described herein and processed in accordance with embodiments of the invention are as follows.

Figure 5:
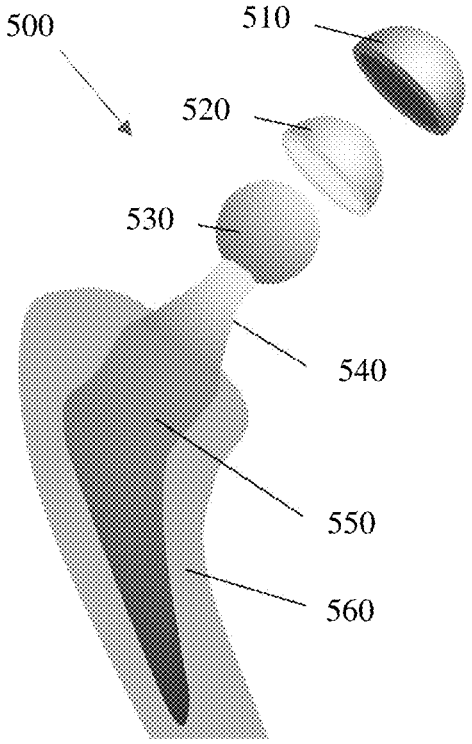
FIG. 5 is a schematic representation of an artificial hip joint.

Embodiments of the invention include articulating orthopedic implants such as a hip prosthesis, knee, or shoulder joint prosthesis. Referring to FIG. 5, a hip prosthesis 500 may include an acetabular socket 510, an insert 520, a femoral head 530, a femoral trunnion 540, and a femoral stem 550. The insert 520 (e.g., polyethylene insert made of ultra-high-molecular-weight polyethylene or UHMWPE) may be disposed in contact with the acetabular socket 510, between the acetabular socket and the femoral head 530. The femoral trunnion 540, i.e., a tapered portion of the hip prosthesis 500, is disposed between the femoral head 530 and the femoral stem 550. As illustrated, the femoral stem 550 may be implanted in a femur 560 of a patient. Accordingly, a hip joint prosthesis typically has at least three elements: femoral stem 550 including a stem portion and a neck (trunnion 540) made of metal, a femoral head 530 made of metal or ceramic, and an acetabular socket 510 that can be made of metal, ceramic or polymer (e.g., polyethylene); these three elements may be fabricated from stainless steel in accordance with embodiments of the invention.

The metal processing methods described herein may be used to fabricate articulating orthopedic implants that include metal, such as: 1) metal on metal contact (MoM), 2) metal on polyethylene contact (MoP), 3) metal on ceramic contact (MoC) and (4) ceramic on metal contact (CoM). Accordingly, hip prosthesis elements that may fabricated in accordance with embodiments of the invention include a femoral stem, a femoral head, and an acetabular socket.

An element formed by processes described herein has the required mechanical properties to be used in the articulating part of the joint replacement. Examples of required mechanical properties include a bulk strength of 120 ksi YS and 170 ksi UTS at room temperature to make the article compatible with the ASTM 799 requirement and a hardness of at least 350 HV.

In particular, an articulating orthopedic device may include a first element consisting essentially of cold worked ASTM F2229 stainless steel, ASTM F1586 stainless steel or HNHC stainless steel and having a first articular surface; and a second element consisting essentially of cold worked ASTM F2229 stainless steel, ASTM F1586 stainless steel or HNHC stainless steel and having a second articular surface configured to articulate with the first articular surface. The first and second articular surfaces each include a surface layer consisting of hardened ASTM F2229 stainless steel, ASTM F1586 stainless steel or HNHC stainless steel with at least one of carbon, nitrogen, or boron diffused therein. In some embodiments, the first element may be an acetabular socket and the second element may be a femoral head. In other embodiments, the first element may be a femoral head and the second element may be a femoral stem.

Furthermore, flat discs made of ASTM F2229 stainless steel, ASTM F1586 stainless steel or HNHC stainless steel can be cold formed to produce acetabular shell blanks and further processed according to embodiments of the invention. Spinal rods can also be made from ASTM F2229 stainless steel, ASTM F1586 stainless steel or the HNHC stainless steel using the processes described herein.

In use, in a hip replacement, a damaged bone and cartilage may be removed and replaced with at least some prosthetic components. For example, a damaged femoral head may be removed and replaced with femoral head 530 attached to a femoral stem 550 that can be placed into the hollow center of the femur 560 by either cementing or press fitting the femoral stem 550 into the femur 560. In another example, a damaged femoral head may be removed and replaced by placing the femoral head 530 on the upper part of the femoral stem. In many cases, the femoral head 530 includes a structure (e.g., ball structure) that connects to the femoral stem 550 via the femoral trunnion 540. In another example, a damaged cartilage surface of a socket (acetabulum) may be removed and replaced with the acetabular socket 510. In some cases, screws or cement are used to hold the socket in place. In another example, the insert 520 (e.g., a plastic, ceramic, or metal spacer) is inserted between the femoral head 530 and the acetabular socket 510 to allow for a smooth gliding surface.

Materials and methods described herein may be used to fabricate watch structural elements such as cases, rings, gears, bracelets, or sections thereof and pins to hold the bracelets.

Furthermore, materials and methods described herein may be used to fabricate non-magnetic parts for applications in the electrification and electronics markets that require high resistance to wear and corrosion such as retainer rings.

Moreover, materials and methods described herein may be used to fabricate instrumentation/non-magnetic housings for the oil & gas industry, as well as bearings, gears, gear teeth, and pump shafts.

Examples

The composition example in Table 1 describes articles made of ASTM F2229 stainless steel, ASTM F1586 stainless steel or HNHC stainless steel after a cold deformation and case hardening step. Further, exemplary compositions in weight percent are given in Table 3 below.

TABLE 3

Composition in wt. % of the experimental stainless-steel alloys melted at Carpenter Technology.

| Element | BioDur ® 108 stainless steel | BioDur ® 734 stainless steel | NCORR ™ stainless steel |
|---|---|---|---|
| Fe | Bal. | Bal. | Bal. |
| Co | <0.01 | <0.10 | <0.01 |
| Mn | 22.96 | 3.23 | 5.98 |

TABLE 3-continued

Composition in wt. % of the experimental stainless-steel alloys melted at Carpenter Technology.

| Element | BioDur ® 108 stainless steel | BioDur ® 734 stainless steel | NCORR ™ stainless steel |
|---|---|---|---|
| Cr | 21.13 | 21.32 | 29.44 |
| Mo | 0.68 | 2.42 | 1.98 |
| N | 1.05 | 0.28 | 0.804 |
| Ni | 0.01 | 10.23 | 15.24 |
| Nb | 0.01 | 0.38 | <0.01 |
| C | 0.038 | 0.047 | 0.027 |
| P | 0.010 | 0.019 | <0.005 |
| S | 0.004 | <0.001 | 0.002 |
| Si | 0.29 | 0.26 | 0.50 |
| O | Not intentionally added | Not intentionally added | Not intentionally added |
| Cu | <0.01 | 0.23 | <0.01 |

The BioDur® 108-, BioDur® 734-, and NCORR™ stainless steel samples were processed using conditions that represent embodiments of the present disclosure (conditions A through H, as shown in FIGS. 6A, 6B, 7A, 7B, 8A, and 8B) as follows:

Condition A=cold working (deformation at room temperature)+low pressure carburizing 1 hr at 500° C.

Condition B=cold working (deformation at room temperature)+low pressure carburizing 4 hr at 550° C.

Condition C=cold working (warm) (deformation at 1200° F.)+low pressure carburizing 4 hr at 550° C.

Condition D=cold working (deformation at room temperature)+low pressure carburizing 16 hr at 550° C.

Condition E=cold working (warm) (deformation at 1200° F.)+low pressure carburizing 16 hr at 550° C.

Condition F=cold working (deformation at room temperature)+low pressure carburizing 4 hr at 750° C.

Condition G=cold working (warm) (deformation at 1200° F.)+low pressure carburizing 4 hr at 750° C.

Condition H=cold working (deformation at room temperature)+low pressure carburizing 5 hr at 960° C.

Figure 6A:
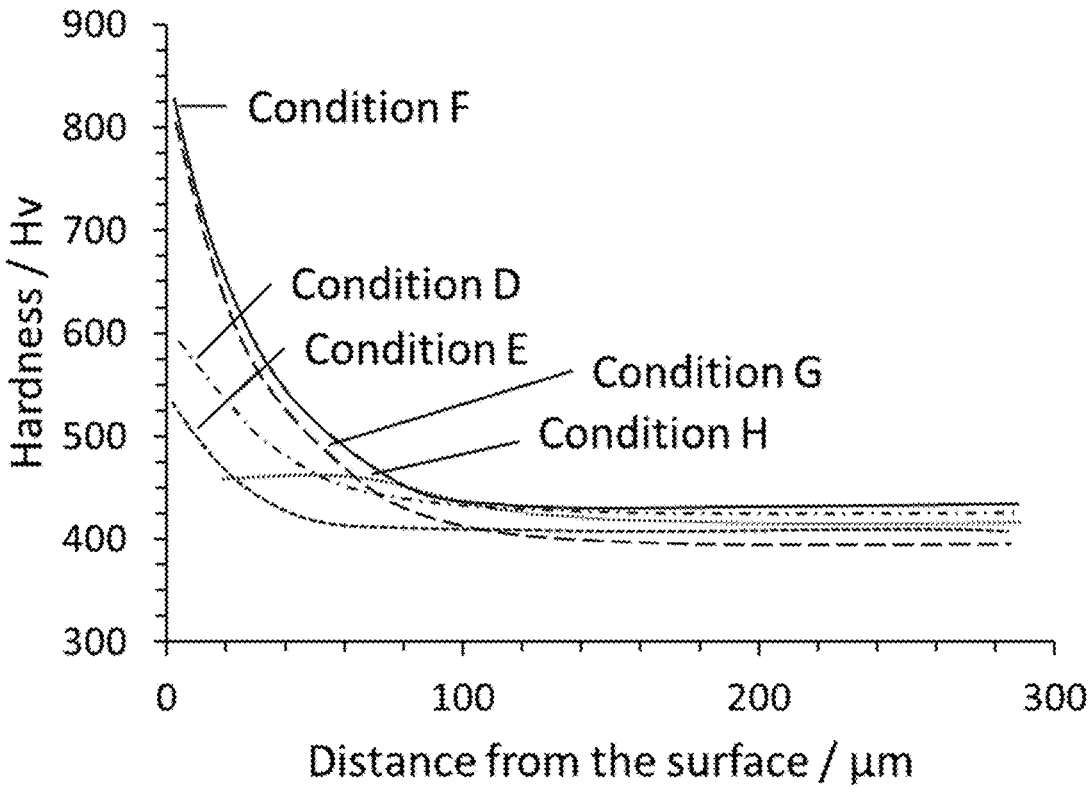
FIG. 6A is a graph illustrating hardness versus distance from a surface of BioDur® 108 stainless steel samples processed in accordance with embodiments of the invention.
Figure 6B:
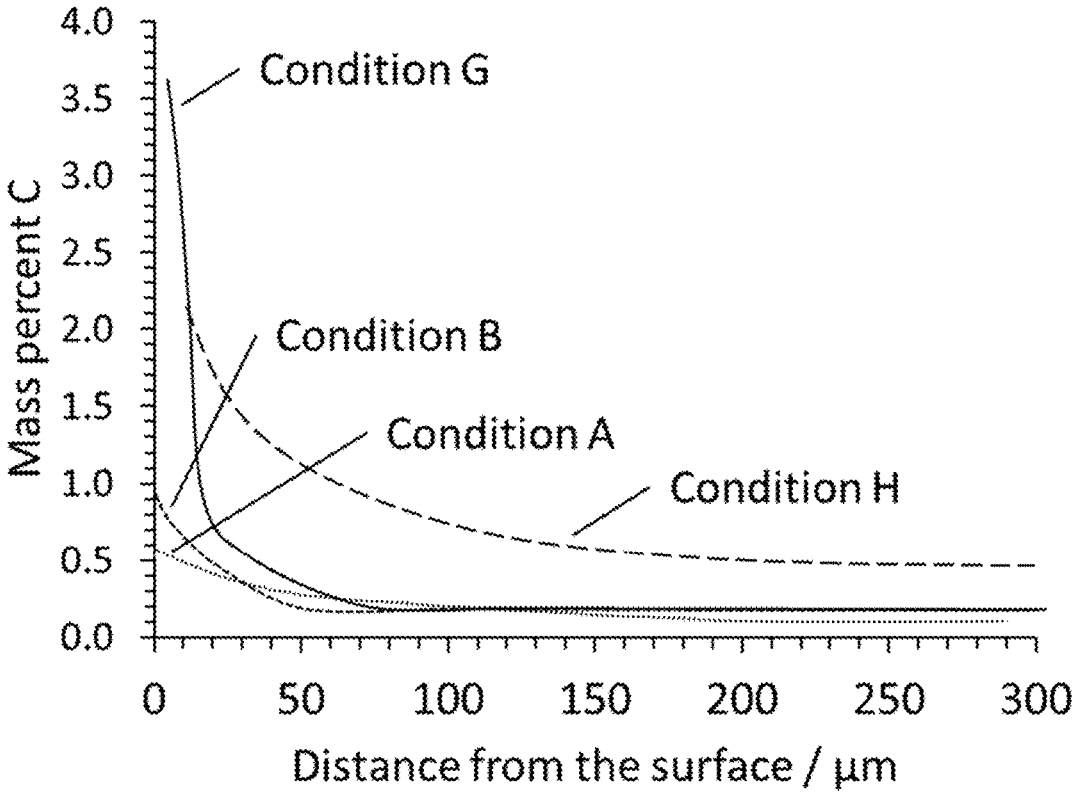
FIG. 6B is a graph illustrating the carbon concentration in wt. % versus distance from a surface of BioDur® 108 stainless steel samples processed in accordance with embodiments of the invention.
Figure 6C:
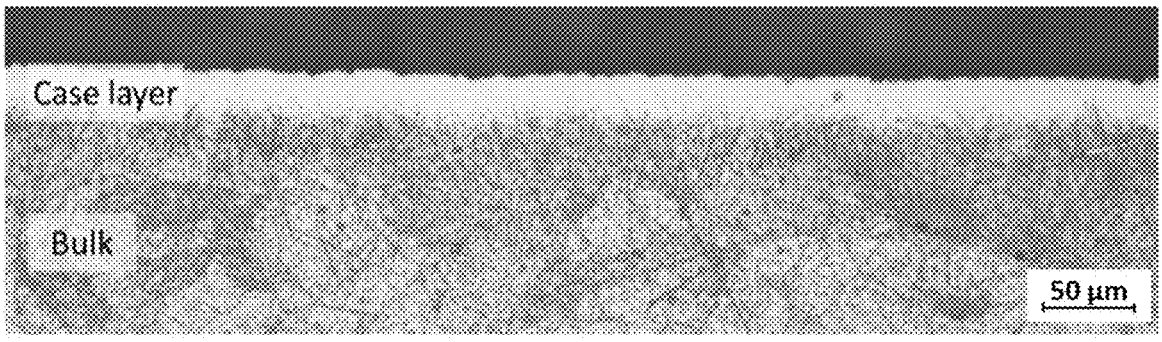
FIG. 6C is a series of micrographs of the samples of FIG. 6A and FIG. 6B.
Figure 6C:
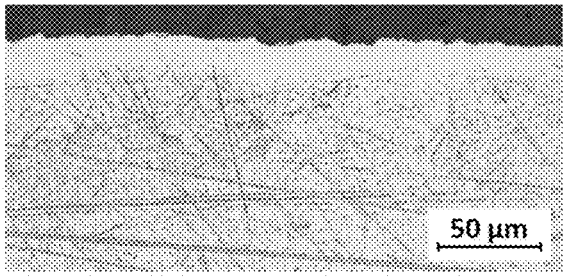
Figure 6C:
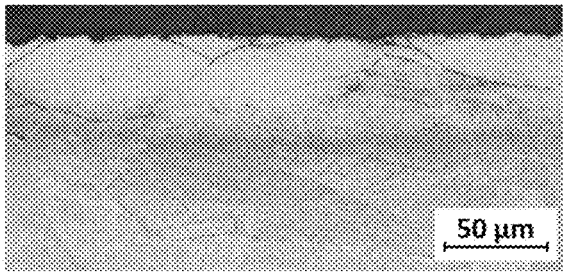
Figure 6C:
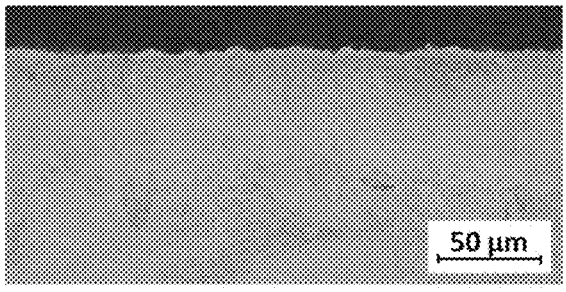
Figure 6C:
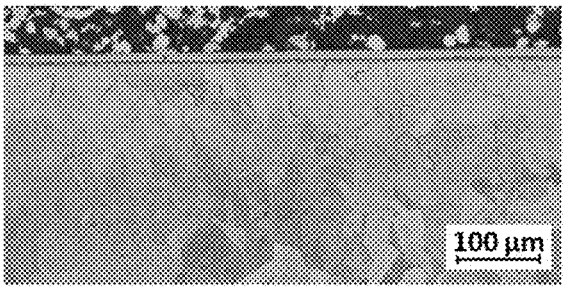

FIG. 6A is a graph illustrating the microhardness (hardness according to Vickers (HV)) of the surface layer of samples of BioDur® 108 stainless steel after five different processing conditions: conditions D, E, F, G, and H. As shown in FIG. 6A, the bulk hardness is about 400 HV and the peak hardness at the surface ranges between at least 510 HV and at least 850 HV depending on the processing conditions. FIG. 6B shows the amount of carbon in solution in the surface layer of samples of BioDur® 108 stainless steel after four different processing conditions: conditions A, B, G and H. The carbon level is close to 0.10 wt. % in the bulk and ranges from 0.50 wt. % to 3.65 wt. % in the surface layer depending on the processing conditions. FIG. 6C includes light optical micrographs showing the visible case layer of some conditions as shown in FIG. 6A. The light optical micrographs in FIG. 6C were taken after etching with waterless Kalling's etchant (conventional mixture of acids used to reveal the alloy microstructure) and show the case surface layer (in brighter tone) and the bulk (darker tone). As shown in FIG. 6C, the thickness of the visible case surface layer is about 20-25 μm (condition A and condition B), 40-50 μm (condition D), 70-80 μm (condition F) or 200-300 μm (condition H).

Figure 7A:
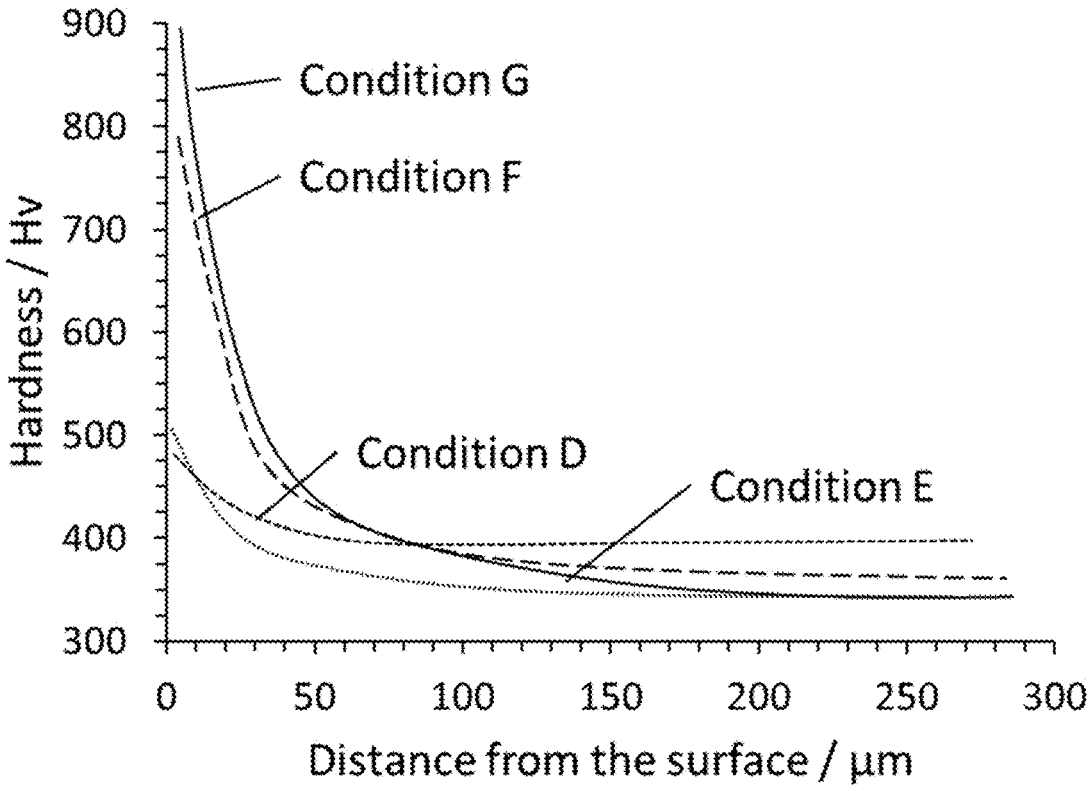
FIG. 7A is a graph illustrating hardness versus distance from a surface of BioDur® 734 stainless steel samples processed in accordance with embodiments of the invention.
Figure 7B:
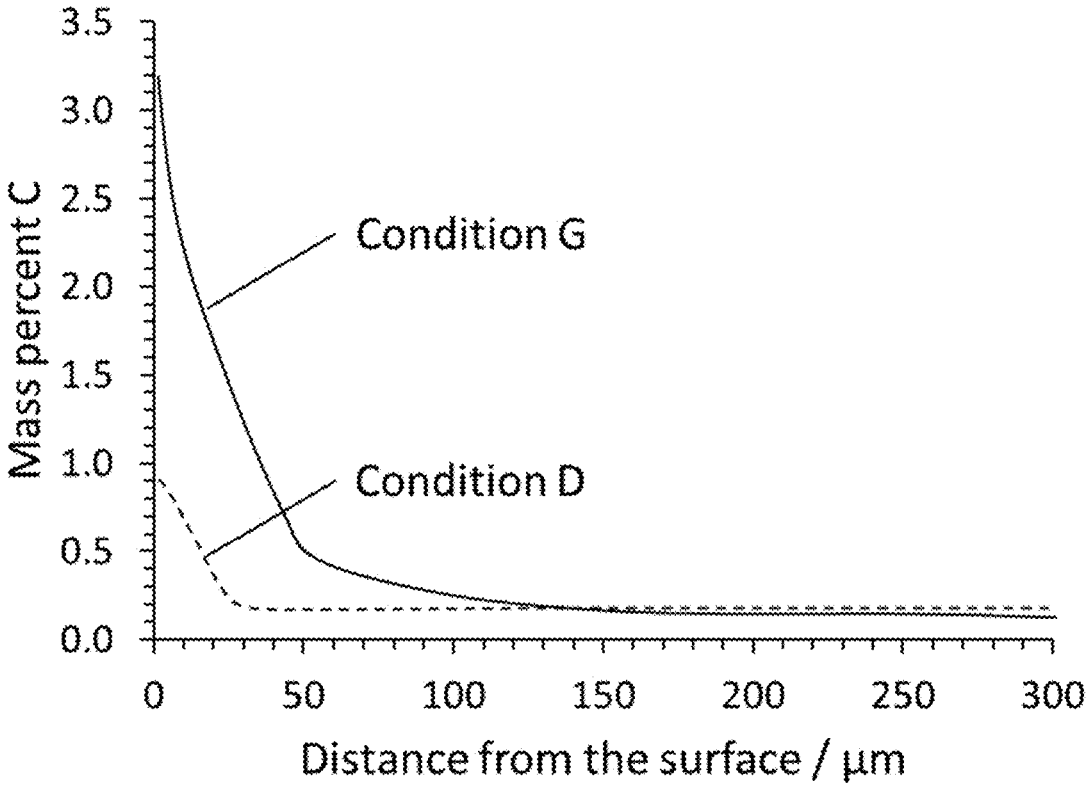
FIG. 7B is a graph illustrating the carbon concentration in wt. % versus distance from a surface of BioDur® 734 stainless steel samples processed in accordance with embodiments of the invention.
Figure 7C:
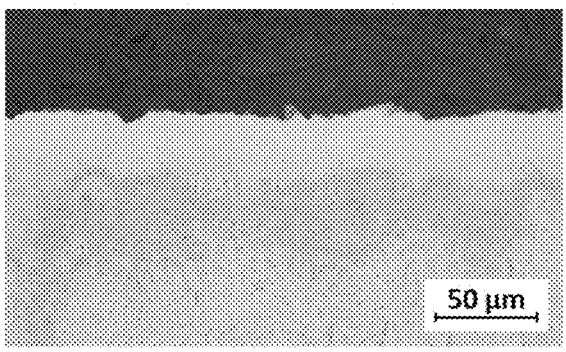
FIG. 7C is a series of micrographs of the samples of FIG. 7A and FIG. 7B.
Figure 7C:
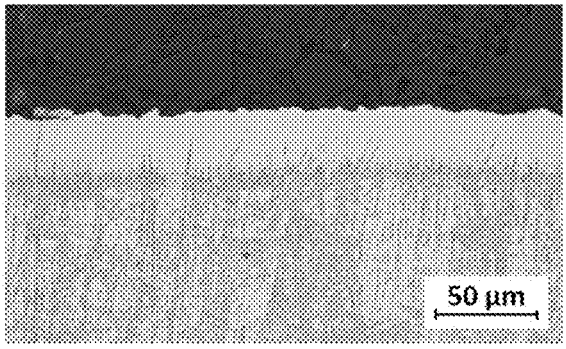
Figure 7C:
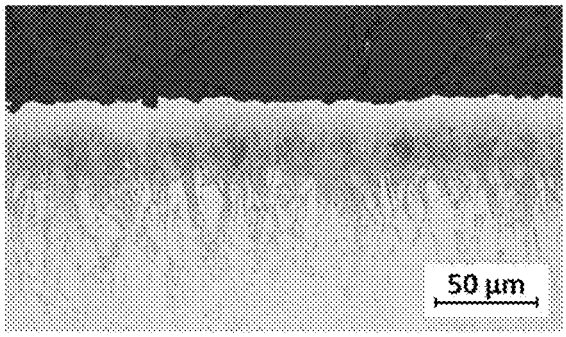
Figure 7C:
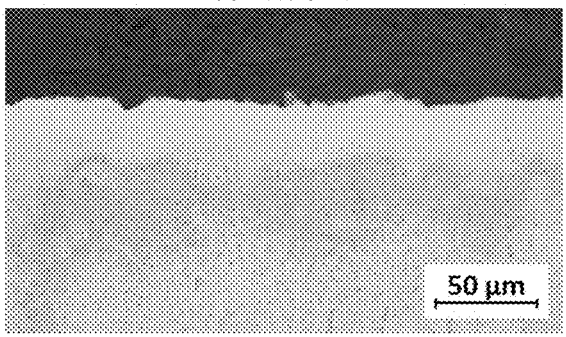

FIG. 7A is a graph illustrating the microhardness (HV) of the surface layer of samples of BioDur® 734 stainless steel processed according to four processing conditions: conditions D, E, F, and G. The bulk hardness is about 350 HV to 400 HV. The hardness of the case layer ranges between 500 HV and 900 HV depending on the processing conditions. FIG. 7B is a graph illustration the carbon composition of the surface layer of samples of BioDur® 734 stainless steel processed according to two processing conditions: conditions D and G. The carbon composition peak in the surface layer ranges between 0.90 wt. % and 3.20 wt. %. FIG. 7C includes light optical micrographs showing the visible case surface layer formed after case hardening in accordance with conditions as shown in FIG. 7A and FIG. 7B. As shown in FIG. 7C, the case surface layer thickness is 30 to 40 μm (condition D and condition E) or 50 μm to 60 μm (condition F and condition G).

Figure 8A:
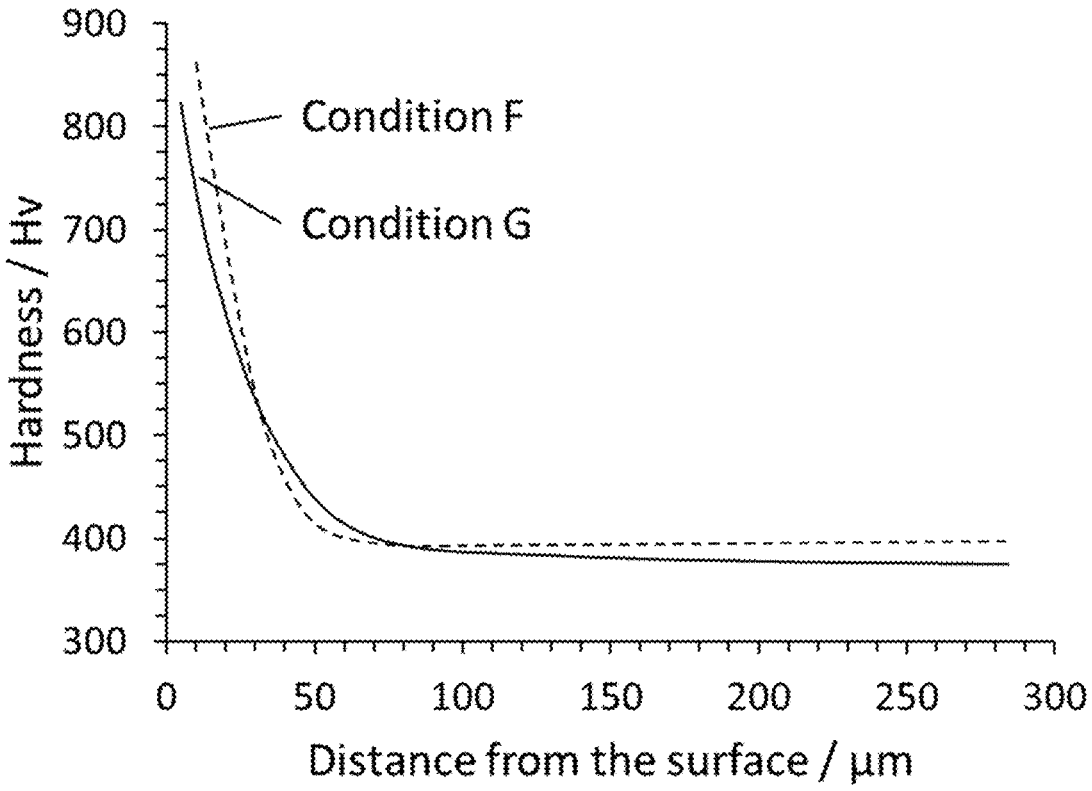
FIG. 8A is a graph illustrating hardness versus distance from a surface of NCORR™ stainless steel samples processed in accordance with embodiments of the invention.
Figure 8B:
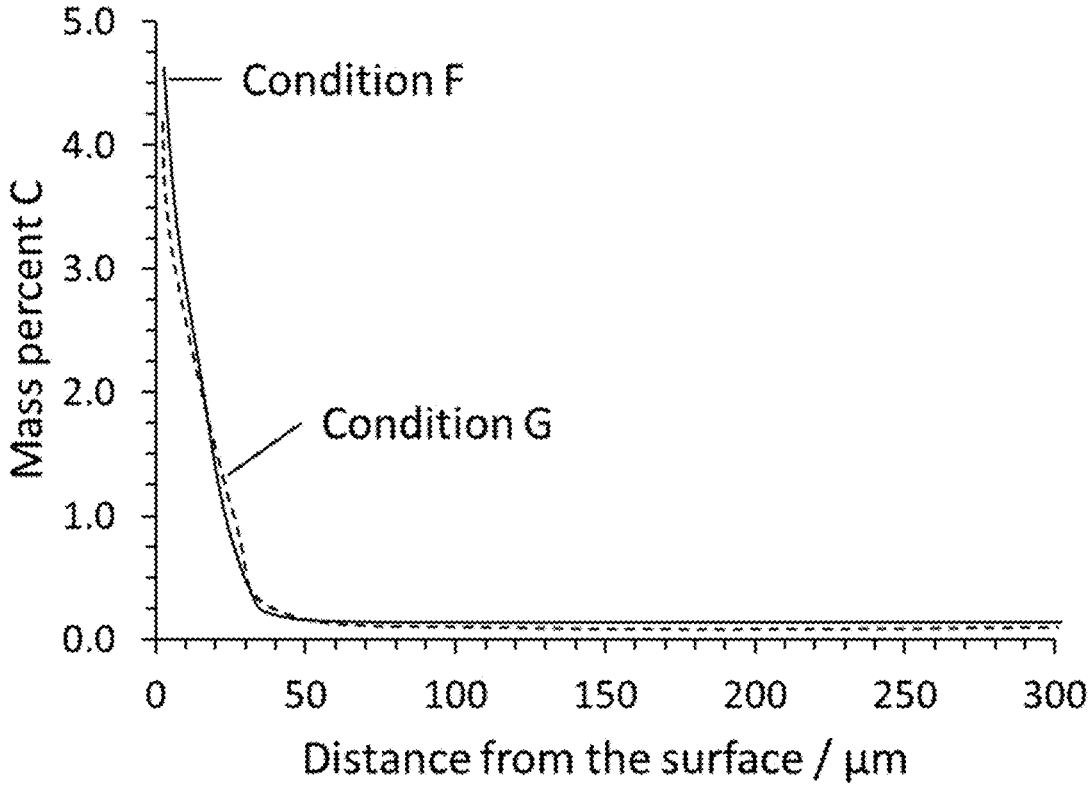
FIG. 8B is a graph illustrating the carbon concentration in wt. % versus distance from a surface of NCORR™ stainless steel samples processed in accordance with embodiments of the invention.
Figure 8C:
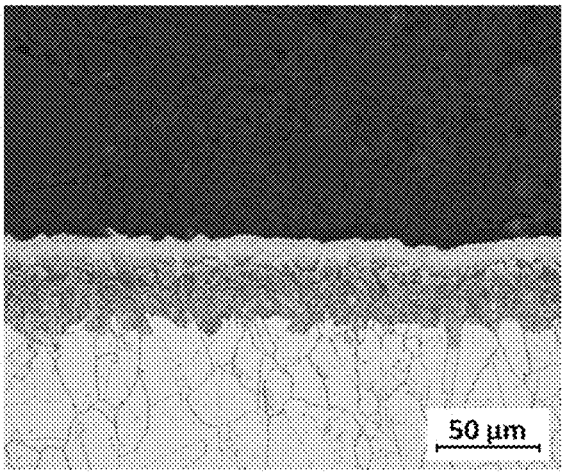
FIG. 8C is a series of micrographs of the samples of FIG. 8A and FIG. 8B.
Figure 8C:
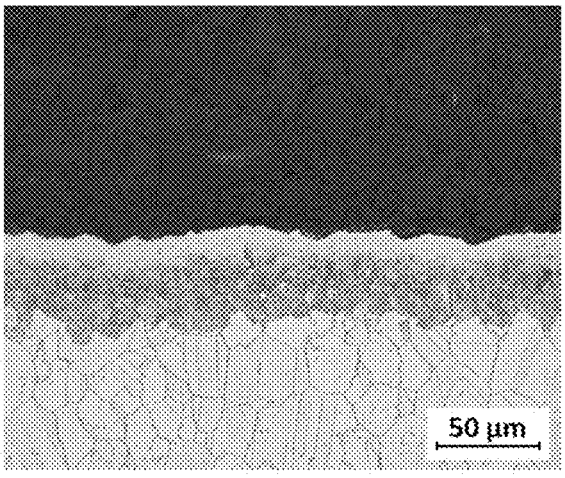

FIG. 8A is a graph illustrating the microhardness (HV) of the surface layer of samples of NCORR™ stainless steel alloy processed according to two conditions: condition F (cold-worked (deformation at room temperature)+carburizing 4 hr at 750° C.) and condition G (cold-worked (warm-worked) (deformation at 1200° F.)+carburizing 4 hr at 750° C.). The bulk hardness is about 350-400 HV and the peak hardness at the surface reached 850 HV to 900 HV. FIG. 8B is a graph illustration the carbon composition of the surface layer of samples of NCORR™ stainless steel processed according to two processing conditions: conditions F and G. The carbon composition peak in the surface layer ranges between 4.10 wt. % and 4.60 wt. %. FIG. 8C includes light optical micrographs showing the visible case surface layer of each condition illustrated in FIG. 8A and FIG. 8B. As shown in FIG. 8C, the case surface layer thickness is about 50 μm to 70 μm (for both conditions).

All references, issued patents and patent applications cited within the body of the specification are hereby incorporated by reference in their entirety, for all purposes.

While the present invention has been described herein in detail in relation to one or more preferred embodiments, it is to be understood that this disclosure is only illustrative and exemplary of the present invention and is made merely for the purpose of providing a full and enabling disclosure of the invention. The foregoing disclosure is not intended to be construed to limit the present invention or otherwise exclude any such other embodiments, adaptations, variations, modifications or equivalent arrangements; the present invention being limited only by the claims appended hereto and the equivalents thereof.

What is claimed is:

1. A method for fabricating an article, comprising the steps of:

forming a billet consisting essentially of a stainless steel composition of manganese 2.00 wt. %-24.00 wt. % chromium 19.00 wt. %-30.00 wt. % molybdenum 0.50 wt. %-4.00 wt. % nitrogen 0.25 wt. %-1.10 wt. % carbon ≤1.00 wt. % phosphorus ≤0.03 wt. % sulfur ≤1.00 wt. % nickel <22.00 wt. % cobalt <0.10 wt. % silicon ≤1.00 wt. % niobium ≤0.80 wt. % oxygen ≤1.00 wt. %
copper ≤0.25 wt. %
balance iron;

annealing the billet;

cold working the billet to form the article; and without annealing of the article, subsequently case hardening the article at a single case hardening temperature to form a surface layer on a top surface thereof, wherein case hardening comprises at least one of boriding, carburizing, nitriding, carbonitriding, or a combination thereof without formation of borides, carbides, nitride, and carbonitrides, wherein (i) the surface layer comprises a surface hardness of at least 350 HV, and (ii) the article comprises an articulating orthopedic device comprising a first element comprising a first articular surface and a second element comprising a second articular surface configured to articulate with the first articular surface, the first and second elements consisting essentially of the stainless steel composition, and wherein the first and second articular surfaces each comprise the surface layer comprising the stainless steel composition and further comprising at least one of carbon, nitrogen, or boron diffused therein.

2. The method of claim 1, wherein the billet consists essentially of a stainless steel composition of manganese 21.00 wt. %-24.00 wt. %
chromium 19.00 wt. %-23.00 wt. %
molybdenum 0.50 wt. %-1.50 wt. %
nitrogen 0.85 wt. %-1.10 wt. %
carbon ≤0.08 wt. %
phosphorus ≤0.03 wt. %
sulfur ≤0.01 wt. %
nickel ≤0.05 wt. %
cobalt <0.10 wt. %
silicon ≤0.75 wt. %
niobium 0.00 wt. %
oxygen not intentionally added
copper ≤0.25 wt. %
balance iron.

3. The method of claim 1, wherein the billet consists essentially of a stainless steel composition of manganese 2.00 wt. %-4.25 wt. %
chromium 19.50 wt. %-22.00 wt. %
molybdenum 2.00 wt. %-3.00 wt. %
nitrogen 0.25 wt. %-0.50 wt. %
carbon ≤0.08 wt. %
phosphorus ≤0.025 wt. %
sulfur ≤0.01 wt. %
nickel 9.00 wt. %-11.00 wt. %
cobalt <0.10 wt. %
silicon ≤0.75 wt. %
niobium 0.25 wt. %-0.80 wt. %
oxygen not intentionally added
copper ≤0.25 wt. %
balance iron.

4. The method of claim 1, wherein the billet consists essentially of a stainless steel composition of manganese 5.85 wt. %-15.00 wt. %
chromium 27.00 wt. %-30.00 wt. %
molybdenum 1.50 wt. %-4.00 wt. %
nitrogen 0.80 wt. %-0.97 wt. %
phosphorus <0.02 wt. %
nickel 8.00 wt. %-22.00 wt. %
cobalt <0.01 wt. %
silicon, oxygen, carbon, and sulfur such that (silicon+oxygen+carbon+sulfur) ≤1.00 wt. %
niobium 0.00 wt. %
copper ≤0.01 wt. %
balance iron.

5. The method of claim 1, wherein forming the billet comprises:

forming a powder comprising the stainless steel composition; and pressing the powder to form the billet.

6. The method of claim 1, wherein cold working the billet comprises at least one of cold forming, cold rolling, cold drawing, shot peening, or pilgering.

7. The method of claim 1, wherein the case hardening temperature is selected from a range of 400° C.-1000° C.

8. The method of claim 7, wherein the case hardening temperature is selected from a range of 400° C.-600° C.

9. The method of claim 8, wherein the case hardening temperature is selected from a range of 400° C.-550° C.

10. The method of claim 1, wherein the case hardening is performed for a duration selected from a range of 1 to 16 hours.

11. The method of claim 1, wherein case hardening comprises boriding.

12. The method of claim 1, wherein case hardening comprises nitriding.

13. The method of claim 1, wherein case hardening comprises carbonitriding.

14. The method of claim 1, wherein the surface hardness is at least 510 HV.

15. The method of claim 1, wherein the surface hardness is at least 850 HV.

16. The method of claim 1, further comprising an acetabular cup disposed between the first and second elements.

17. The method of claim 16, wherein the acetabular cup comprises at least one of a metal, a ceramic, or a polymer.

* * * * *